US006881181B2

(12) United States Patent
Brown et al.

(10) Patent No.: US 6,881,181 B2
(45) Date of Patent: Apr. 19, 2005

(54) SHEET FOLDING APPARATUS

(75) Inventors: Robert H. Brown, Etobicoke (CA); Jeff Farrell, Brampton (CA); Stephen Abellera, Scarborough (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/408,925

(22) Filed: Apr. 7, 2003

(65) Prior Publication Data

US 2004/0198578 A1 Oct. 7, 2004

(51) Int. Cl.[7] ..... B31F 1/00
(52) U.S. Cl. ..... 493/419; 493/420
(58) Field of Search ..... 493/405, 419, 493/420, 424, 434, 442; 270/47, 32, 39.08

(56) References Cited

U.S. PATENT DOCUMENTS 3,632,104 A * 1/1972 Dufour ..... 493/444
4,057,241 A * 11/1977 Buss et al. ..... 493/21
4,647,029 A 3/1987 Ohmori ..... 270/45
4,717,134 A 1/1988 Iida et al. ..... 270/39
4,985,013 A * 1/1991 van der Werff et al. .... 493/444
5,108,082 A 4/1992 Shea et al. ..... 270/47
5,634,875 A * 6/1997 Fisk et al. ..... 493/422
5,769,774 A * 6/1998 Beck et al. ..... 493/421
5,980,443 A * 11/1999 Kayser et al. ..... 493/420
6,132,352 A * 10/2000 Rider ..... 493/419
6,206,817 B1 * 3/2001 Sette et al. ..... 493/421
6,635,006 B1 * 10/2003 Auerbach et al. ..... 493/419

* cited by examiner

*Primary Examiner*—Eugene Kim
(74) *Attorney, Agent, or Firm*—R. Hutter

(57) ABSTRACT

A sheet folding apparatus, which may be used in conjunction with a printer or copier, includes a set of rollers forming a buckle zone, in which sheets are caused to buckle for creasing by a folding nip formed by the rollers. A blade is selectably positionable in and out of the buckle zone. When the blade is positioned in the buckle zone, any previously-folded portion of the sheet (such as in C-folding of the sheet) is prevented from being drawn away from the folding nip.

6 Claims, 3 Drawing Sheets

SHEET FOLDING APPARATUS

TECHNICAL FIELD

The present disclosure relates to a sheet-folding apparatus, as would be used, for example, in the context of digital printing and mailing machines.

BACKGROUND

Apparatus for the automated folding, such as C-folding and Z-folding, of letter-size and similar sheets are well-known. It is also generally known to provide such apparatus in conjunction with a copier or digital printer, for folding print sheets which those machines output.

A typical folding apparatus includes three selectably-contacting rollers, forming two nips between adjacent pairs of rollers. For a sheet being folded, a portion of the length of the sheet is caused to buckle near one of the nips, until that portion of the sheet is contacted by two rollers and drawn through the nip. The drawing of the sheet through the nip results in a sharp fold. For different types of folding of a sheet, such as C-folding and Z-folding, different portions of the sheet are caused to buckle in a predetermined sequence adjacent different nips. In order to cause the buckling of the correct portion of the sheet, the edge sheet is typically pushed against a stop surface in a fixed position relative to the nip.

DESCRIPTION OF THE PRIOR ART

U.S. Pat. Nos. 4,647,029 and 5,108,082 are examples of recent designs of folding apparatus.

U.S. Pat. No. 4,717,134 discloses, at FIG. 12 thereof, a sheet folding apparatus, for use in conjunction with a digital printer or copier, where a positionable deflector is disposed in a zone adjacent the nips formed by a plurality of rollers.

SUMMARY OF THE INVENTION

According to one aspect of the present invention, there is provided an apparatus for folding sheets, comprising a first roller and a second roller, forming a first nip therebetween, and defining a buckle zone adjacent to the first nip. A blade is disposed on a pivotable mount, the pivotable mount defining an axis displaced out of the buckle zone. The blade is positionable in a first position out of the buckle zone, and in a second position in the buckle zone.

DETAILED DESCRIPTION

Figure 1:
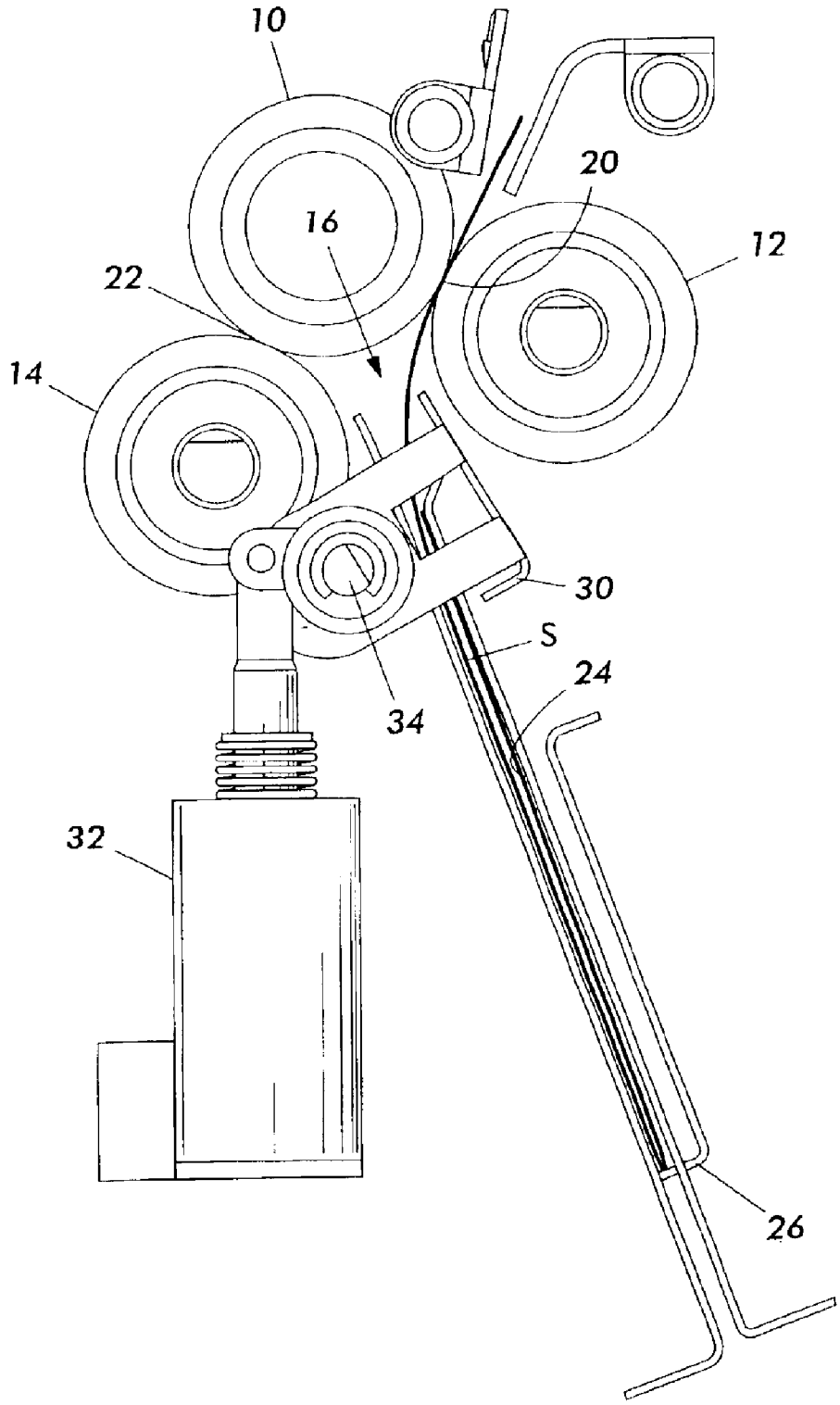
FIGS. 1 and 2 are comparative elevational views showing the operation of essential elements of a sheet folder.
Figure 2:
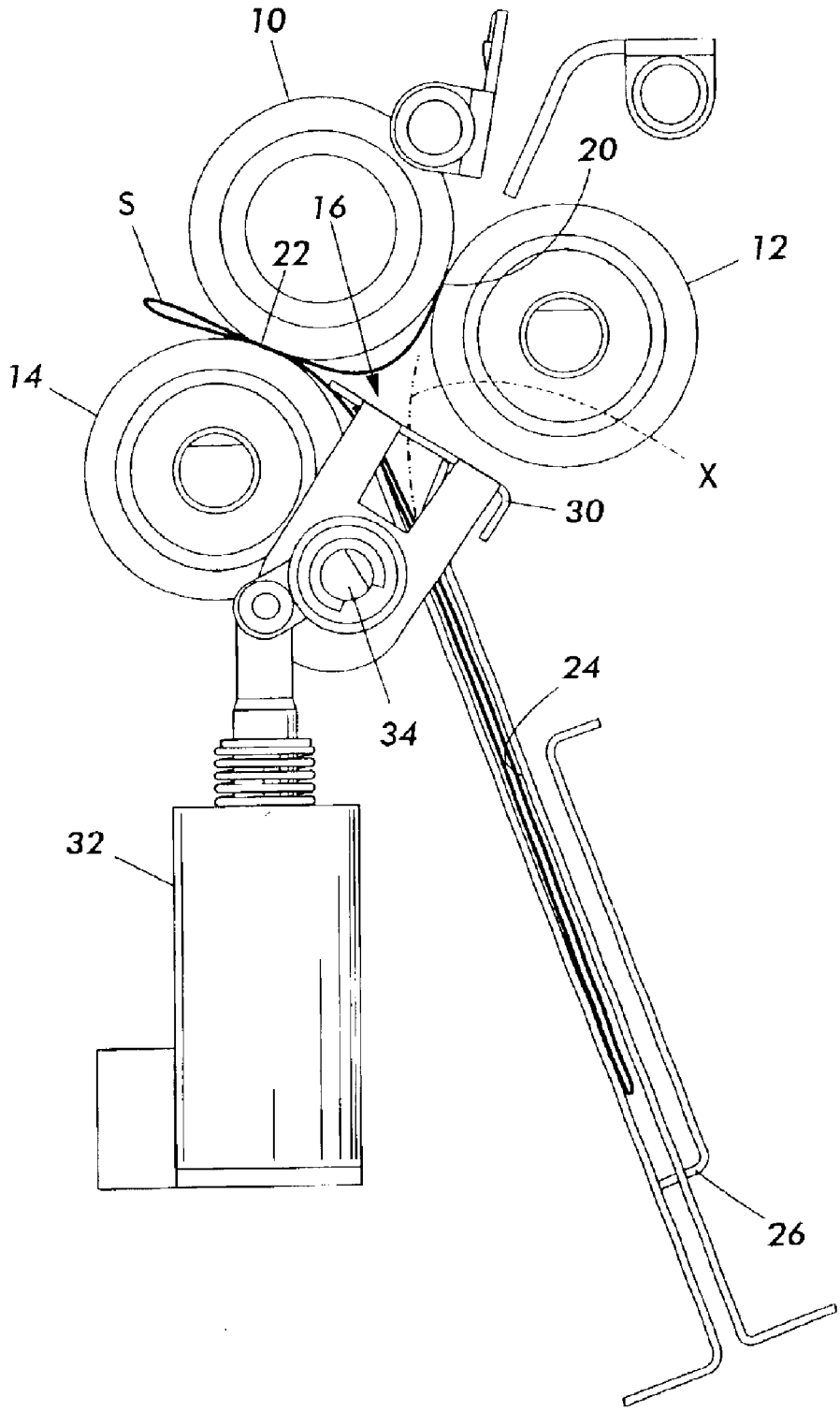

FIGS. 1 and 2 are comparative elevational views showing the operation of essential elements of a sheet folder according to one embodiment. In each figure, there is shown three rollers, 10, 12, and 14. Rollers 10 and 12 form a entry nip 20 therebetween, through which a sheet is introduced; rollers 10 and 14 form a folding nip 22 therebetween. The zone bounded on three sides by roller 10, 12, and 14 is called "buckle zone" 16. The various rollers are caused to rotate in various directions via one or more motors (not shown) under the control of a central control system, such as embodied in a processor (not shown), in a manner generally familiar in the art.

In operation, a sheet S is drawn through entry nip 20, by the rotation of rollers 10 and 12. In a practical embodiment, by the time sheet S is drawn through entry nip 20, it may already have been folded elsewhere within a larger apparatus, such as to form the first fold of a C-fold or a Z-fold, as would be found in machines that fold letter-size sheets to fit in letter envelopes. (Also, although a single sheet S is shown in the Figures, the embodiment could readily be adapted to operate on multiple overlapping sheets simultaneously.) As the sheet S is drawn through entry nip 20, the effective lead edge thereof (which, once again, may be the creased portion of a previously-folded sheet) is directed into a slot 24, at the end of which is defined a backstop 26. When the lead edge of sheet S is pushed against backstop 26 by the motion of rollers 10 and 12, the portion of sheet S in buckle zone 16 will buckle toward folding nip 22, as shown in FIG. 1. Once the buckled portion of sheet S is contacted by rollers 10 and 14, the sheet S is drawn into folding nip 22, which will form a sharp crease or fold in sheet S.

In a practical embodiment, and as known in the prior art, when the illustrated apparatus is used to create a C-fold, the portion of the sheet S which has already been folded is liable to be directed toward entry nip 20, just as the buckled portion of sheet S approaches folding nip 22. As can be seen from the pre-folded portion X of sheet S in FIG. 2, such a situation is likely to result in a jam to the apparatus, or at least an undesirable creasing or crumpling of the output folded sheet.

In order to avoid this situation, the present embodiment provides a movable blade 30, which is selectably positionable in and out of buckle zone 16. As shown, blade 30 is movable between a de-actuated position such as shown in FIG. 1 and an actuated position such as shown in FIG. 2. The blade 30 is moved between these positions by a solenoid 32, or equivalent device such as a stepper motor. The blade 30 pivots around an axis 34. Significantly, axis 34 is displaced from the buckle zone 16; when the blade 30 is de-actuated as in FIG. 1, essentially none of the blade is disposed within buckle zone 16.

As shown in FIG. 2, the blade 30 is actuated when the buckled portion of sheet S is approaching the folding nip 22 to form a crease. The size and position of blade 30 in the actuated position is such that it effectively separates entry nip 20 from buckle zone 16, so that a folded portion of sheet S is not drawn toward folding nip 22, as would happen to pre-folded portion X (shown in phantom) if the blade 30 were not in its actuated position. Once the now-twice-folded sheet S is drawn through folding nip 22, blade 30 is re-positioned to its de-actuated position of FIG. 1, so that a new sheet can be drawn through entry nip 20 toward backstop 26.

Figure 3:
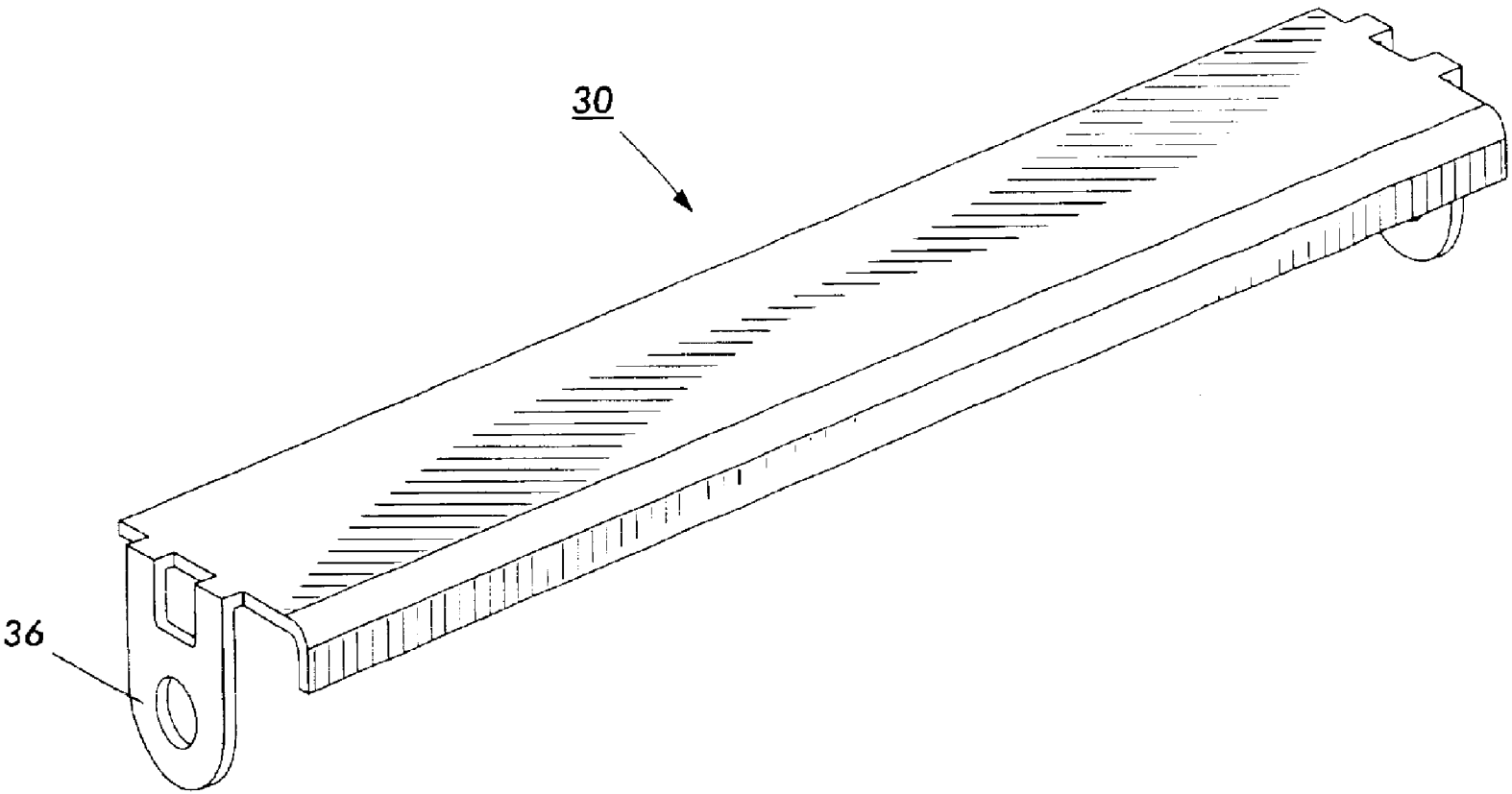
FIG. 3 a perspective view of blade useable with the present embodiment, in isolation.

FIG. 3 a perspective view of blade 30, in isolation. The main portion of blade 30 is a flat, relatively thin member, as opposed to a member having, for example, an appreciable triangular profile in cross-section. Attached to the member is at least one flange 36, which would be rigidly attached to axis 34 for positioning of blade 30. The flange enables the bulk of blade 30 to be spaced from axis 34, so that axis 34 can be disposed well away from buckle zone 16; and the effective axis of rotation of blade 30 on axis 34 can be in effect "through" a portion of roller 14, or any other roller, depending on a specific design.

The present embodiment differs from the disclosure of FIG. 12 of the '134 patent mentioned above. In that disclosure, the diverters such as indicated as 22, 26, and 31 are not in the form of flat, thin blades, nor are they pivotable around axes which are significantly disposed away from what could be considered a buckle zone near any nip in the mechanism.

What is claimed is:

1. An apparatus for folding sheets, comprising:

a first roller and a second roller, forming a first nip therebetween, defining a buckle zone adjacent to the first nip;

a third roller, forming an second nip with the first roller;

a blade disposed on a pivotable mount, the pivotable mount defining an axis displaced out of the buckle zone;

the blade being positionable in a first position out of the buckle zone, and in a second position in the buckle zone, whereby, when the blade is positioned in the second position, the blade separates the second nip from the buckle zone.

2. The apparatus of claim 1, wherein the axis is disposed in effect through a portion of one of the first roller and second roller.

3. The apparatus of claim 1, the blade being substantially thin.

4. The apparatus of claim 1, further comprising means for positioning the blade in the second position as the first roller and second roller direct a sheet toward the first nip.

5. The apparatus of claim 1, wherein, when the blade is in the second position, the blade is positioned to prevent a portion of a sheet from approaching the second nip.

6. The apparatus of claim 1, further comprising means for positioning the blade in the first position when a sheet is passing through the second nip.

* * * * *